US012631000B2

(12) United States Patent
Ishizaka et al.

(10) Patent No.: US 12,631,000 B2
(45) Date of Patent: May 19, 2026

(54) SOIL-AND-SAND INTRUSION PREVENTING STRUCTURE

(71) Applicant: TAKEUCHI MFG. CO., LTD., Hanishina-gun (JP)

(72) Inventors: Satoshi Ishizaka, Nagano (JP); Kazuya Hirose, Nagano (JP); Shingo Takeuchi, Nagano (JP)

(73) Assignee: TAKEUCHI MFG. CO., LTD. (JP)

( * ) Notice: Subject to any disclaimer, the term of this patent is extended or adjusted under 35 U.S.C. 154(b) by 233 days.

(21) Appl. No.: 18/751,912

(22) Filed: Jun. 24, 2024

(65) Prior Publication Data

US 2025/0129569 A1 Apr. 24, 2025

(30) Foreign Application Priority Data

Oct. 23, 2023 (JP) ..... 2023-181723

(51) Int. Cl.
*E02F 9/08* (2006.01)

(52) U.S. Cl.
CPC ..... *E02F 9/0891* (2013.01)

(58) Field of Classification Search
CPC ..... E02F 9/0891; B60R 2019/525; B60R 2019/527; B60K 11/04; B60K 11/08
See application file for complete search history.

(56) References Cited

U.S. PATENT DOCUMENTS 5,376,423 A * 12/1994 Wiegand ..... B60J 10/32 428/595
5,411,785 A * 5/1995 Cook ..... B60J 10/80 52/716.5
5,671,820 A * 9/1997 Kobayashi ..... E02F 9/0891 180/69.21
6,457,543 B1 * 10/2002 Wooldridge ..... B60K 11/04 49/492.1
6,634,449 B2 * 10/2003 Randolph ..... B62D 25/10 180/69.24
7,255,189 B2 * 8/2007 Kurtz, Jr. ..... B60K 11/04 123/41.43
7,261,173 B2 * 8/2007 Kurtz, Jr. ..... E02F 9/0891 180/69.2

(Continued)

FOREIGN PATENT DOCUMENTS

JP 2017-089364 A 5/2017

*Primary Examiner* — Jeffrey J Restifo
(74) *Attorney, Agent, or Firm* — Harness, Dickey & Pierce, P.L.C.

(57) ABSTRACT

A soil-and-sand intrusion preventing structure includes: a rear door; a bumper disposed to protrude more downward and rearward than the rear door when the rear door is closed; a soil-and-sand intrusion preventing wall member that extends longer than an opening range of an opening between rear end wall portions of body frames disposed on the left and right sides of a vehicle body, and is fixed to an upper surface of the bumper; and a flexible trim mounted on a trim mounting plate disposed inside and below a peripheral edge of a rear door frame constituting the rear door, the flexible trim having a planar shape that follows a planar shape of the soil-and-sand intrusion preventing wall member, wherein the trim is brought into contact with the soil-and-sand intrusion preventing wall member over an entire length thereof when the rear door is closed.

4 Claims, 7 Drawing Sheets

(56) References Cited

U.S. PATENT DOCUMENTS

| | | | | |
|---|---|---|---|---|
| 7,556,309 | B2 * | 7/2009 | Ayabe | E02F 9/0891 296/193.11 |
| 8,777,295 | B2 * | 7/2014 | Charnesky | E05C 19/002 49/358 |
| 8,893,834 | B2 * | 11/2014 | Berkeland | E02F 9/0891 296/100.09 |
| 8,936,127 | B2 * | 1/2015 | Kanamaru | E02F 9/0866 180/69.24 |
| 9,061,573 | B2 * | 6/2015 | Zaccaria | B60J 10/277 |
| 10,584,465 | B2 * | 3/2020 | Sakon | B60K 11/02 |
| 12,252,865 | B2 * | 3/2025 | Torii | B62D 25/10 |
| 12,352,008 | B2 * | 7/2025 | Yoshida | E02F 9/0833 |
| 12,467,228 | B2 * | 11/2025 | Kudo | E02F 9/0866 |
| 12,473,714 | B2 * | 11/2025 | Takaki | E02F 9/0808 |
| 2016/0333550 | A1 * | 11/2016 | Matsumura | E02F 9/0891 |
| 2025/0058623 | A1 * | 2/2025 | Ishizaka | B60K 11/08 |
| 2026/0002337 | A1 * | 1/2026 | Hirano | E02F 9/0891 |

* cited by examiner

SOIL-AND-SAND INTRUSION PREVENTING STRUCTURE

CROSS REFERENCE TO RELATED APPLICATIONS

This application claims priority to Japanese Patent Application No. 2023-181723, filed on Oct. 23, 2023, which is expressly incorporated herein by reference in its entirety.

TECHNICAL FIELD

The present invention relates to a soil-and-sand intrusion preventing structure.

BACKGROUND ART

As a working vehicle, there have been widely known a crawler-type skid-steer loader, a hydraulic excavator and the like that are used in digging the ground or moving the dug soil and sand. It is often the case where these working vehicles perform an operation by flinging up foreign substances such as soil and sand as well as plants. Accordingly, when an opening portion exists in an outer shell portion of a vehicle, the foreign substances enter the inside of the vehicle through the opening portion, and are stacked in the inside of the vehicle thus giving rise to a possibility that the working vehicle cannot perform its functions. Further, to remove the stacked foreign substances, work of taking off obstructive parts becomes necessary so that the working is interrupted.

As an example of a working vehicle, there has been known a working vehicle where an arm mounting portion that has an inner space and is referred to as an arm post is mounted on a rear portion of the working vehicle. In the inner space of the arm post, an arm and a base end portion of a hydraulic cylinder are rotatably mounted. Further, an opening portion through which the arm and the base end portion of the hydraulic cylinder are inserted into the inner space is formed. The opening portion is formed with a relatively large opening so as to prevent the arm and the hydraulic cylinder from interfering with each other when they are being operated. Foreign substances such as soil and sand are liable to intrude into and to be stacked in the opening portion. In view of such circumstances, there has been proposed a working vehicle where a cleaning opening portion capable of removing foreign substances such as soil and sand that have entered the inner space is formed on a rear end surface of the arm post (see Japanese Laid-open patent publication No. 2017-89364, for example).

In the working vehicle described in Japanese Laid-open patent publication No. 2017-89364, the cleaning opening portion is formed at two portions, that is, left and right portions of the rear end surface of the arm post respectively. The cleaning opening portion is disposed at a position where foreign substances that intrude into the inner space of the arm post can be removed. During working, one of the cleaning opening portions at two portions is closed by a rear door, and the other cleaning opening portion is covered by a cover plate. Accordingly, there is no possibility that foreign substances intrude into the inner space of the arm post from the cleaning opening portions.

In the working vehicle, the rear door has the openable and closable structure and hence, a gap is formed between the rear door and a bumper so as to prevent the interference between these two members. With respect to the gap formed between the bumper and the rear door which are disposed at a position closer to the ground than the opening portion of the above-mentioned arm post, there may be a case where foreign substances such as soil, sand and the like intrude into an engine compartment from the gap. However, in the working vehicle described in Japanese Laid-open patent publication No. 2017-89364, a means that prevents the intruding of foreign substances is not provided in the gap between the bumper and the rear door. Accordingly, there exists a drawback that foreign substances such as soil, sand and the like intrude into the engine compartment through the gap formed between the bumper and the rear door and are stacked in the engine compartment. These foreign substances such as soil and sand are stacked between equipment such as an engine or a radiator and a vehicle body frame that forms a lower portion of a vehicle and hence, the foreign substances cannot be easily removed.

The present invention has been made to overcome such drawbacks, and it is an object of the present invention to realize a soil-and-sand intrusion preventing structure capable of preventing the intrusion of soil, sand and the like through a gap formed between an upper surface of a bumper and a lower portion of a rear door.

SUMMARY

[1] A soil-and-sand intrusion preventing structure according to the present invention includes: a rear door that is openable and closable; and a bumper that is disposed to protrude more downward and rearward than the rear door in a state where the rear door is closed. The soil-and-sand intrusion preventing structure includes a soil-and-sand intrusion preventing wall member that extends longer than an opening range of an opening portion formed between rear end wall portions of body frames that are disposed on both left and right sides of a vehicle body, and is fixed to an upper surface of the bumper. The soil-and-sand intrusion preventing structure is mounted on a trim mounting plate that is disposed inside and below a peripheral edge portion of a rear door frame that forms the rear door, and further, includes a flexible trim having a planar shape that follows a planar shape of the soil-and-sand intrusion preventing wall member. The trim is configured to be brought into with the soil-and-sand intrusion preventing wall member over an entire length of the soil-and-sand intrusion preventing wall member when the rear door is closed.

In the above-described configuration, the term "soil and sand" also includes sand, gravel, powdery sand, and plants, and these materials are collectively referred to as soil and sand.

[2] In the soil-and-sand intrusion preventing structure according to the present invention, it is preferable that the soil-and-sand intrusion preventing wall member be formed of a round steel bar. It is preferable that the soil-and-sand intrusion preventing wall member include: a center extending portion that is spaced apart from the rear end wall portion toward a rear side as viewed in a plan view and extends along the rear end wall portion; and distal-end-side extending portions that extend from both ends of the center extending portion to positions where those reach the rear end wall portions. It is preferable that an angle made by the center extending portion and the extending portions be an obtuse angle, and the center extending portion and the distal end extending portions are connected with each other by circular arcs.

[3] In the soil-and-sand intrusion preventing structure according to the present invention, it is preferable that the trim is constituted of: a trim mounting plate inserting portion having a U shape where a side of the trim mounting plate inserting portion into which trim mounting plate is inserted is opened; and a hollow sealing portion that is disposed at a position where the sealing portion is capable of being brought into contact with the soil-and-sand intrusion preventing wall member.

[4] In the soil-and-sand intrusion preventing structure according to the present invention, it is preferable that the sealing portion is positioned and has a shape such that the sealing portion is brought into contact with the soil-and-sand intrusion preventing wall member from a peak portion of the soil-and-sand intrusion preventing wall member to a surface on a rear side of the soil-and-sand intrusion preventing wall member when the rear door is closed.

Advantageous Effects of Invention

The soil-and-sand intrusion preventing structure described above includes the trim having flexibility that is disposed below the rear door; and the soil-and-sand intrusion preventing wall member that is fixed to the upper surface of the bumper. The soil-and-sand intrusion preventing structure extends so as to cover the opening portion between the rear end wall portions on left and right sides of the vehicle body as viewed in a plan view. Further, the trim has a shape following shape of the soil-and-sand intrusion preventing wall member. Still further, the trim is configured to be brought into contact with the soil-and-sand intrusion preventing wall member over an entire length of the soil-and-sand intrusion preventing wall member when the rear door is closed. With such a configuration, the soil-and-sand intrusion preventing structure can prevent the intrusion of soil, sand and the like through a gap between a lowermost portion of the rear door and an upper surface of the bumper.

DETAILED DESCRIPTION

Hereinafter, "a soil-and-sand intrusion preventing structure 40" according to an embodiment of the present invention is described with reference to drawings.

(Configuration of Working Vehicle 1)

Figure 1:
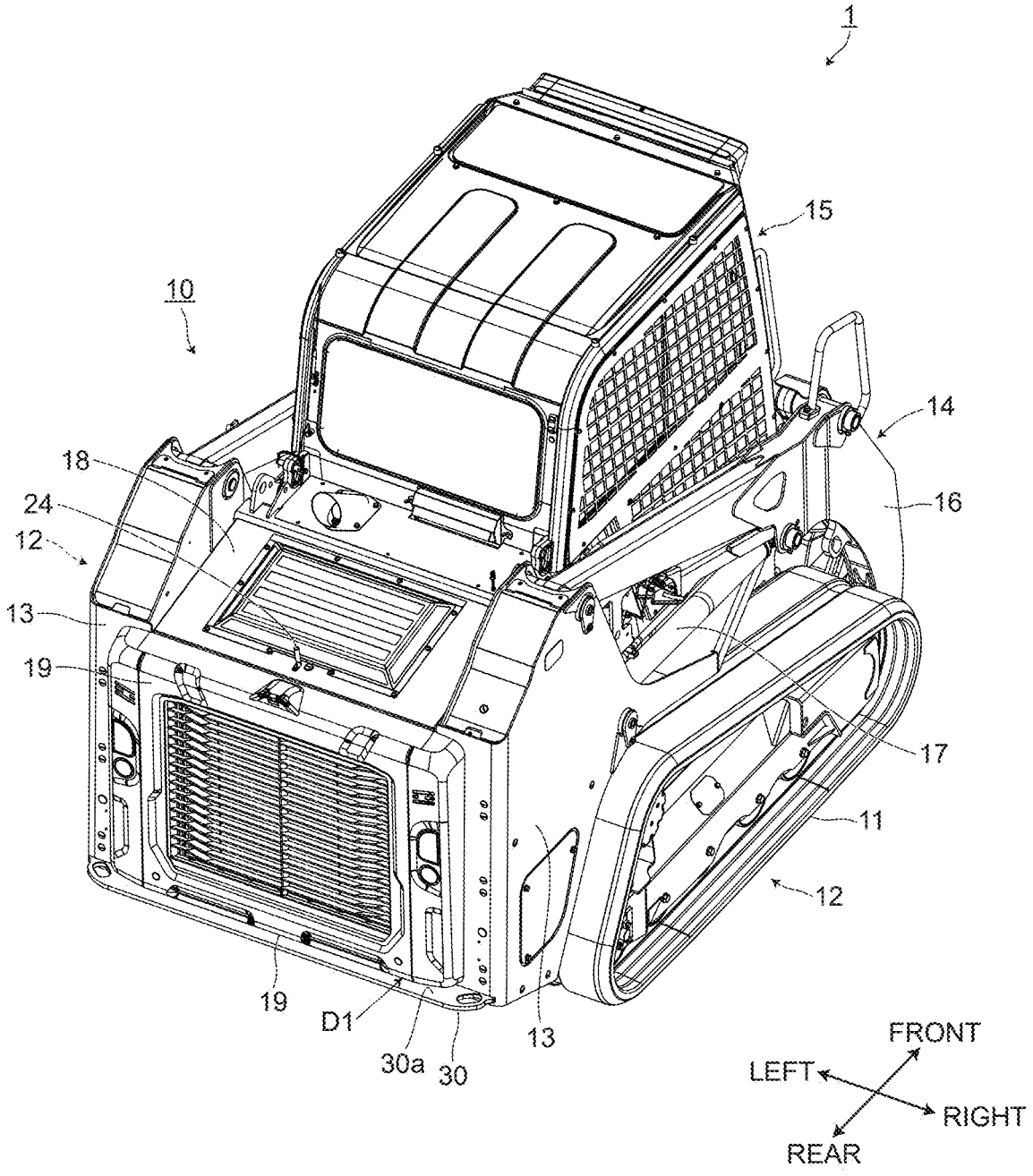
FIG. 1 is a perspective view illustrating an overall structure of one constitutional example of a working vehicle 1 as viewed from a rear side.

FIG. 1 is a perspective view illustrating an overall structure of one constitutional example of a working vehicle 1 as viewed from a rear side. Further, in FIG. 1, directions of respective portions with respect to a vehicle body 10 are indicated by arrows. That is, in FIG. 1, a direction of forward travel of the working vehicle 1 is set as "front", a direction of reverse travel of the working vehicle 1 as "rear", a right side of the working vehicle 1 as viewed toward the direction of forward travel is set as "right" and a left side of the working vehicle 1 as viewed toward the direction of forward travel is set as "left".

The working vehicle 1 includes a pair of left and right travelling devices 12 each of which is formed of a crawler 11 on a lower side of both sides of the vehicle body 10 in a vehicle width direction. The travelling devices 12 are mounted respectively on the vehicle body frames 13 disposed on both left and right sides of the vehicle body 10. A working device 14 is mounted on a front side of the body frame 13, and a cabin 15 is disposed on a center upper portion of the vehicle body 10.

The working vehicle 14 includes: a pair of arms 16 that are disposed so as to sandwich a left and right sides of the cabin 15; and a pair of left and right hydraulic cylinders 17 that are mounted on the body frame 13 and the arm 16 in a straddling manner. Although not illustrated in the drawing, the working device 14 has a working attachment such as a bucket that is mounted on front end portions of the arms 16 via brackets.

The working vehicle 1 includes an engine compartment 20 (see FIG. 6) that is a space where left and right sides are surrounded by body frames 13, an upper side is surrounded by an engine cover 18, and a rear side is surrounded by a rear door 19. An engine (not illustrated in the drawing) and the like are disposed in the inside of the engine compartment 20.

The engine cover 18 is configured such that a side of the rear door 19 is openable and closable in a vertical direction using a hinge (not illustrated in the drawing) on a side of the cabin 15 as a fulcrum. The engine cover 18 is held in a closed state with respect to the body frames 13 by an engine cover lock mechanism 24 in a normal operation. Further, the engine cover 18 is configured to be opened upward at the time of performing maintenance or the like. On the other hand, the rear door 19 is configured such that a right side is opened toward a left side as viewed in a plane view using hinge mechanisms 31A, 31B (see FIG. 2) as fulcrums, which are disposed between the body frame 13 on the left side and a rear door frame 26.

The rear door 19 is held in a closed state by a rear door lock lever 25 (see FIG. 2) in a normal operation, and can be brought into an open state by pulling up the rear door lock lever 25.

The vehicle body 10 includes the bumper 30 that is disposed in a manner of protruding toward a side below and behind the rear door 19 when the rear door 19 is closed. Between a lowermost portion 19*a* of the rear door 19 and an upper surface 30*a* of the bumper 30, a gap D1 that allows the rear door 19 to open or close without interfering with the bumper 30 is formed. There is a concern that soil and sand intrude into the engine compartment 20 (see FIG. 6) during working through the gap D1 disposed at the position close to a ground.

In view of the above, the working vehicle 1 includes the soil-and-sand intrusion preventing structure 40 (see FIG. 6) that prevents the intrusion of soil and sand into the gap D1 formed between the rear door 19 and the bumper 30. In this embodiment, "soil and sand" is a collective term of foreign substances including sand, pebbles, gravels, powdery sand and plants. The soil-and-sand intrusion preventing structure 40 is described with reference to respective drawings consisting of FIG. 2 and succeeding drawings.

Figure 2:
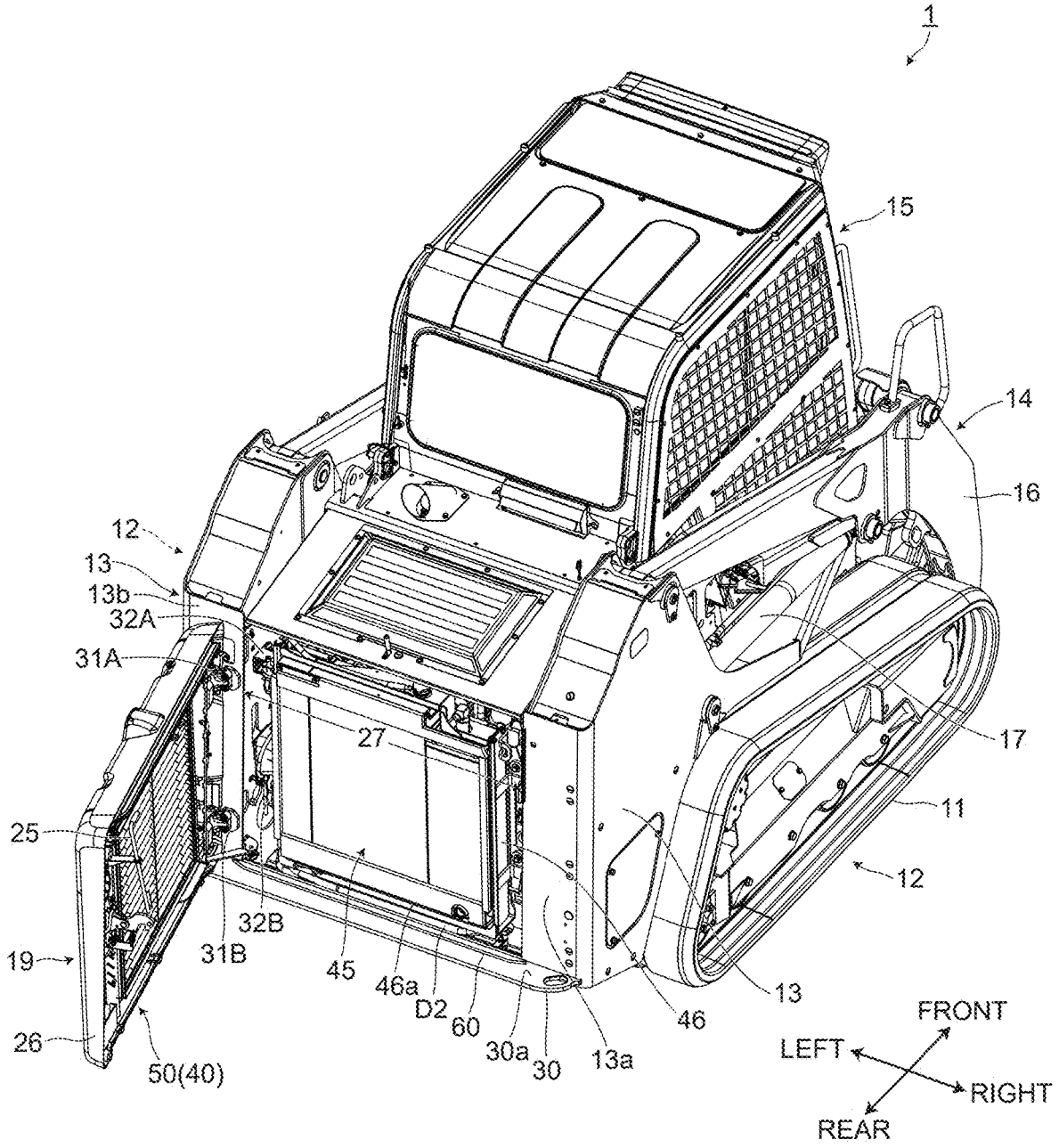
FIG. 2 is a perspective view illustrating a state where a rear door 19 is opened.

FIG. 2 is a perspective view illustrating a state where the rear door 19 is opened. The configuration of the working vehicle 1 is equal to the configuration illustrated in FIG. 1 and hence, the identical constitutional elements are given with the same symbols used in FIG. 1. When the rear door 19 is brought into an open state by pulling up a rear door lock lever 25, a radiator 45 appears on a front face of the vehicle body 10 on a rear side.

On a left side of the body frame 13 and a radiator frame 46, hinge mechanisms 32A, 32B are provided at two upper and lower positions. The radiator 45 is supported such that a right side of the radiator 45 is openable or closable in a left and right direction as viewed in a plan view using the hinge mechanisms 32A, 32B as fulcrums. In such a configuration, to allow the radiator 45 to be openable and closable without making the radiator 45 interfere with the bumper 30, a gap D2 (see FIG. 6) is formed in the vertical direction between a lowermost portion 46*a* of the radiator frame 46 and the upper surface 30*a* of the bumper 30.

The soil-and-sand intrusion preventing structure 40 is constituted of: a soil-and-sand intrusion preventing wall member 60; and a trim 50 that is described later. The soil-and-sand intrusion preventing wall member 60 that forms one member of the soil-and-sand intrusion preventing structure 40 is fixed to an upper surface 30*a* of the bumper 30. The soil-and-sand intrusion preventing wall member 60 is formed of a rod (also referred to as round steel bar) made of steel having a circular cross-sectional shape. On a rear side of the vehicle body 10, between a rear end wall portion 13*a* of the body frame 13 on a right side and a rear end wall portion 13*b* of the body frame 13 on a left side, an opening portion 27 that allows the radiator 45 to be openable and closable is provided. The configuration of the soil-and-sand intrusion preventing wall member 60 is explained with reference to FIG. 3.

The rear door 19 is formed of the rear door frame 26 that has a recessed structure on a surface thereof on a side of a radiator 45. On a lower portion of an inner side of a peripheral edge portion 26*a* of the rear door frame 26, the trim 50 that forms the other member of the soil-and-sand intrusion preventing structure 40 is disposed. The trim 50 is integrally joined to the rear door 19, and moves following an operation of the rear door 19. The configuration of the trim 50 is described with reference to FIG. 4 and FIGS. 5A, 5B and 5C.

Figure 3:
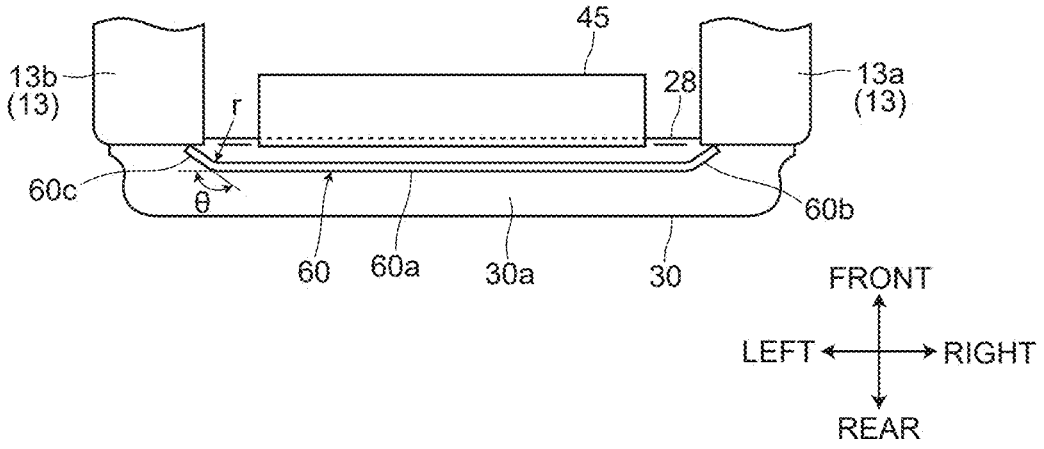
FIG. 3 is an explanatory view schematically showing a planar shape of a soil-and-sand intrusion preventing wall member 60 that is fixed t a bumper 30.

FIG. 3 is an explanatory view that schematically illustrates a planar shape of the soil-and-sand intrusion preventing wall member 60 that is fixed to the bumper 30. In FIG. 3, the illustration of the engine cover 18, the rear door 19 and the like is omitted. As viewed in a plan view, the soil-and-sand intrusion preventing wall member 60 includes: a center extending portion 60*a*; and two distal-end-side extending portions 60*b*, 60*c* disposed on both distal ends of the center extending portion 60*a*. The center extending portion 60*a* is spaced apart and extends rearward from a transversal line that traverses between an extending end of the rear end wall portion 13*a* of the body frame 13 on a right side and an extending end of the rear end wall portion 13*b* of the body frame 13 on a left side, and extends along the rear end wall portions 13*a*, 13*b*. The distal-end-side extending portions 60*b*, 60*c* extend to the positions where both ends of the center extending portion 60*a* reach the rear end wall portions 13*a*, 13*b*.

The soil-and-sand intrusion preventing wall member 60 has a circular cross section, and is formed of the center extending portion 60*a*, and distal-end-side extending portions 60*b*, 60*c*, and an angle θ made between the center extending portion 60*a* and the distal-end-side extending portions 60*b*, 60*c* is set to an obtuse angle. The center extending portion 60*a* and the distal-end-side extending portions 60*b*, 60*c* are connected with each other in a smooth rounded manner by way of circular arcs r. By forming the soil-and-sand intrusion preventing wall member 60 in such a shape, the soil-and-sand intrusion preventing wall member 60 can maintain both front and back surface thereof in a state where these surfaces have no unevenness such as wrinkles and cracks that are liable to be caused at the time of performing bending forming. As a result, it is possible to bring the trim 50, which is described later uniformly into contact with the soil-and-sand intrusion preventing wall member 60 over an entire length thereof. In this embodiment, the soil-and-sand intrusion preventing wall member 60 is formed of the center extending portion 60*a* and the distal-end-side extending portions 60*b*, 60*c*. However, it is possible to form the entirety of the soil-and-sand intrusion preventing wall member 60 constituted of the center extending portion 60*a* and the distal-end-side extending portions 60*b*, 60*c* into a continuous gently curved shape.

It may not always be the case that the cross-sectional shape of the soil-and-sand intrusion preventing wall member 60 is a true circle. An elliptical shape, a polygonal shape having no corners are also applicable as the cross-sectional shape of the soil-and-sand intrusion preventing wall member 60. Further, by fixing the soil-and-sand intrusion preventing wall member 60 by welding at a contact portion between the soil-and-sand intrusion preventing wall member 60 and the bumper 30, floating or the like can be prevented and hence, a sufficient fixing strength can be obtained. The bumper 30 is a portion that extends from a lower body frame 28 (see FIG. 6) disposed below the vehicle body 10

Figure 4:
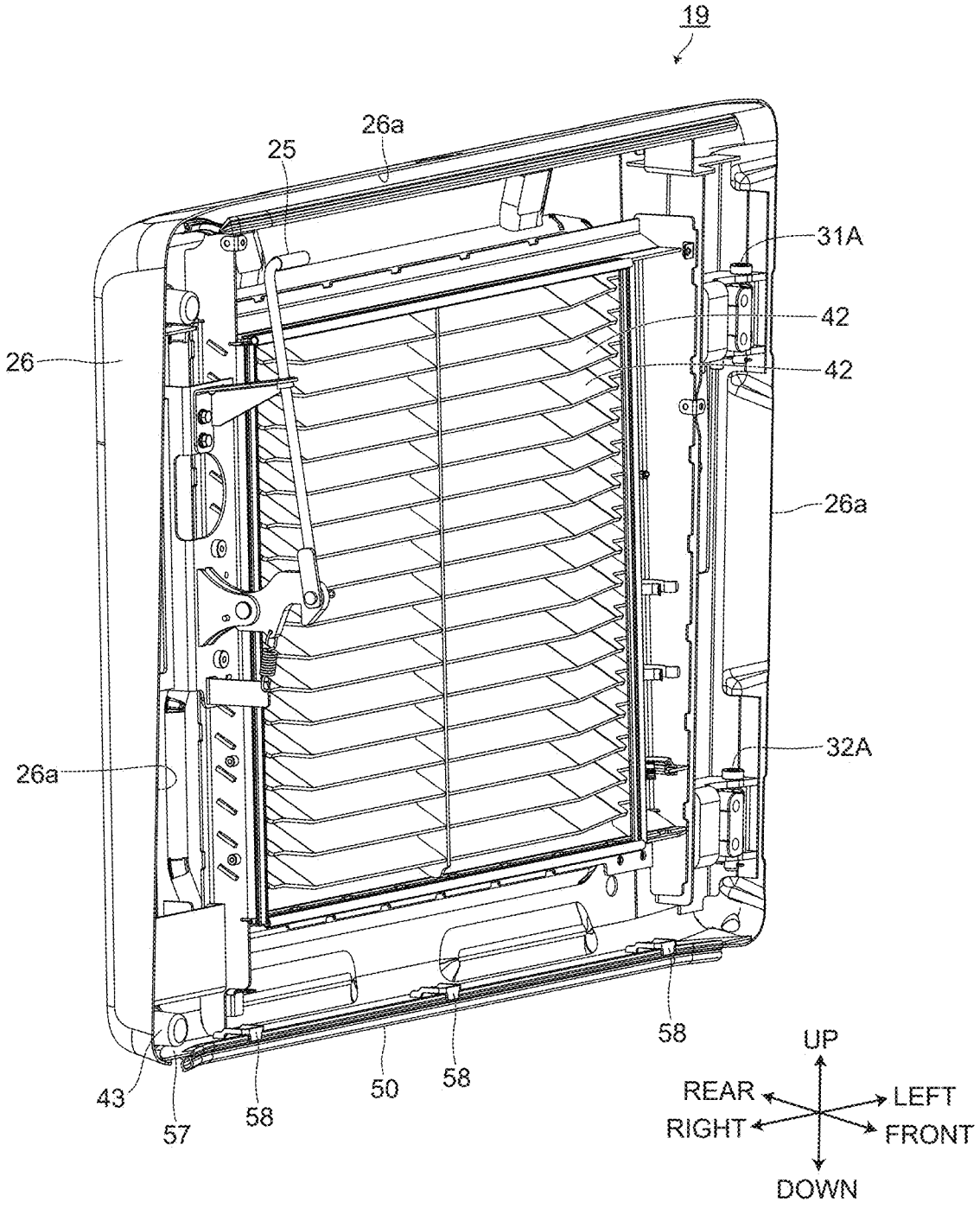
FIG. 4 is a perspective view of the rear door 19 on which a trim 50 is mounted as viewed from an inner side (a vehicle body side)

FIG. 4 is a perspective view of the rear door 19 on which the trim 50 is mounted, viewed from the inside (from the vehicle body). The rear door frame 26 has a recessed shape surrounded by the peripheral edge portion 26*a*. When the rear door 19 is closed, the peripheral edge portion 26*a* faces rear end wall portions 13*a* 13*b* (see FIG. 2) with a suitable distance therebetween. The rear door 19 has hinge mechanisms 31A, 31B on an end portion of the rear door 19 on a left side, and is mounted on the vehicle body 10 in an openable and closable manner by the hinge mechanism 31A, 31B. A plurality of louvers 42 are mounted in a center portion of the rear door frame 26. An opening is formed between the louvers 42 disposed adjacently to each other for allowing the opening to discharge warmed air to the outside from the engine compartment 20 (see FIG. 6).

The rear door lock lever 25 is disposed on a right side of the rear door 19. Stoppers 43 are mounted on upper and lower portions of the right side of the rear door frame 26 (see FIG. 4). The stoppers 43 are provided for absorbing an impact generated when the rear door 19 is closed, and for keeping an appropriate distance between the rear end wall portions 13*a*, 13*b* of the body frame 13 and the peripheral edge portion 26*a* of the rear door frame 26 (see FIG. 4).

A trim mounting plate 57 is disposed between the left and right sides of the peripheral edge portion 26*a* of the rear door frame 26 at a lower portion of the rear door frame 26, and protrudes toward the vehicle body 10 (see FIG. 2). The trim 50 is mounted on an end portion of the trim mounting plate 57. A trim removal preventing member 58 is also mounted on the trim mounting plate 57. The trim removal preventing member 58 is provided for preventing the removal of the trim 50 from the trim mounting plate 57 at the time of opening or closing the rear door 19. In FIG. 4, three trim removal preventing members 58 are used. However, the number of trim removal preventing members 58 may be increased or decreased such as two or four, for example. Next, the configuration of the trim 50 is described.

Figure 5A:
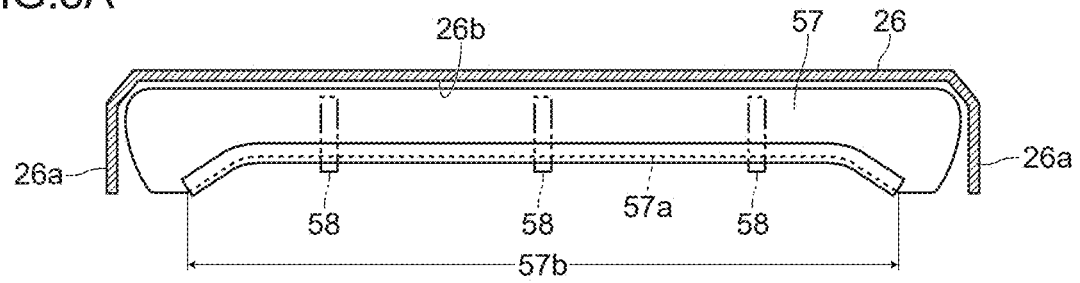
FIGS. 5A, 5B and 5C are explanatory views, each of which is illustrating the configuration of the trim 50.
Figure 5B:
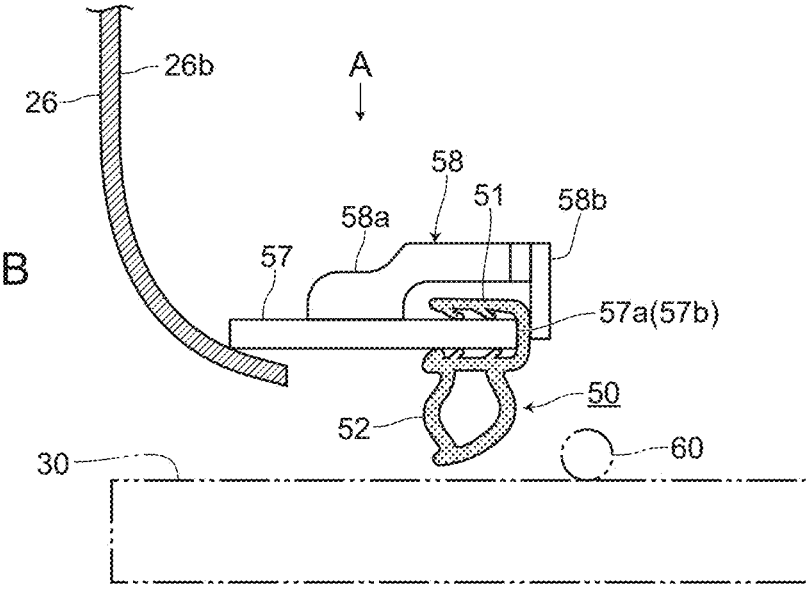
Figure 5C:
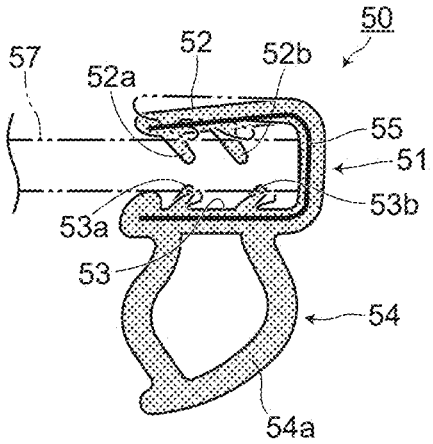

FIGS. 5A, 5B and 5C are explanatory views, each of which is illustrating the configuration of the trim 50. FIG. 5A is a plan view illustrating a state where the trim 50 is mounted on the trim mounting plate 57. FIG. 5B is a cross-sectional view illustrating the state where the trim 50 is mounted on the trim mounting plate 57. FIG. 5C is a cross-sectional view illustrating the cross-sectional configuration of the trim 50. The respective views in FIGS. 5A, 5B and 5C are schematic views where scales and aspect ratios are different from each other. The state where the trim 50 is mounted on the trim mounting plate 57 is described with reference to FIG. 5A. FIG. 5A illustrates a state as viewed from a direction of an arrow A in FIG. 5B.

As illustrated in FIG. 5A and FIG. 5B, the trim mounting plate 57 is fixed to an inner side surface 26*b* by welding or the like horizontally at lower portion of the inner sides of the peripheral edge portion 26*a* of the rear door frame 26. A side surface 57*a* of the trim mounting plate 57 on a side opposite to the rear door frame 26 has a planner shape that follows the soil-and-sand intrusion preventing wall member 60 thus forming a trim mounting portion 57*b*. The trim 50 is mounted on the trim mounting portion 57*b* by following the shape of the side surface 57*a*. Accordingly, the trim 50 has the planner shape that follows the shape of the soil-and-sand intrusion preventing wall member 60 and hence, it is possible to bring the trim 50 into contact with the soil-and-sand intrusion preventing wall member 60 over an entire length thereof.

The trim 50 has flexibility and hence, the trim may be formed by molding into a shape that is developed in a straight line shape, and may be mounted following the shape of the trim mounting portion 57*b*. Alternatively, the trim 50 may be formed by molding in advance in a shape that follows the shape of the trim mounting portion 57*b*. As illustrated in FIG. 5B, the trim 50 is constituted of a trim mounting plate inserting portion 51 and a sealing portion 54. The sealing portion 54 is a portion that is brought into contact with the soil-and-sand intrusion preventing wall member 60 when the rear door 19 is closed. The trim mounting plate inserting portion 51 and the sealing portion 54 are formed over the entire length of the soil-and-sand intrusion preventing wall member 60.

A trim removal preventing member 58 is fixed to the trim mounting plate 57. As illustrated in FIG. 5B, the trim removal preventing member 58 is constituted of: a body portion 58*a* that is fixed to the trim mounting plate 57 by welding; and a trim position restricting portion 58*b* that extends from the body portion 58*a* and restricts the movement of the trim 50 toward a front side. The trim position restricting portion 58*b* vertically extends from the body portion 58*a* to an area in the vicinity of the center of the trim mounting plate inserting portion 51 of the trim 50 in cross section. It is possible that the trim removal preventing member 58 is configured to be detachably mounted on the trim mounting plate 57 by volts and nuts. With such a configuration, it is possible to easily mount the trim removal preventing member 58 on the trim mounting plate 57 of the trim 50. Next, the cross-sectional configuration of the trim 50 is described in further detail.

As illustrated in FIG. 5C, the trim 50 is constituted of the trim mounting plate inserting portion 51 having a U shape that opens on a side from which the trim mounting plate 57 is inserted into the trim mounting plate inserting portion 51; and the hollow sealing portion 54 that can be brought into contact with the soil-and-sand intrusion preventing wall member 60. The trim mounting plate inserting portion 51 having a U shape includes one straight line portion 52 and the other straight line portion 53. Protruding portions 52*a*, 52*b* are formed on one straight line portion 52, and protruding portions 53*a*, 53*b* are formed on the other straight line portion 53. A distance between distal ends of the protruding portions 52*a*, 52*b* and distal ends of the protruding portions 53*a*, 53*b* is set smaller than a thickness of the trim mounting plate 57. The protruding portions 52*a*, 52*b*, 53*a*, 53*b* are respectively inclined in a direction that facilitates the insertion of the trim mounting plate 57 into the trim mounting plate inserting portion 51. Accordingly, the trim mounting plate inserting portion 51 is formed in a shape that enables the insertion of the trim mounting plate 57 and makes the removal of the trim mounting plate 57 difficult. In FIG. 5C, a state where the trim 50 is mounted on the trim mounting plate 57 is indicated by a dash-double-dot line.

The trim 50 is formed by molding using a material having flexibility. In a U-shaped portion of the trim mounting plate inserting portion 51, a reinforcing metal plate 55 is inserted as a core member. The core member may be formed by stacking hard resin layers in two layers or three layers by molding thus avoiding the use of the reinforcing metal plate 55.

On a lower side of the straight line portion 53 of the trim mounting plate inserting portion 51, the sealing portion 54 is integrally formed with the trim mounting plate inserting portion 51. The sealing portion 54 is constituted of a ring portion 54*a*. The ring portion 54*a* has flexibility and hence, when the ring portion 54*a* is brought into contact with the soil-and-sand intrusion preventing wall member 60, a portion of the ring portion 54*a* that intersects with the soil-and-sand intrusion preventing wall member 60 is deformed. The soil-and-sand intrusion preventing structure 40 is constituted of the trim 50 and the soil-and-sand intrusion preventing wall member 60 described above.

(Soil-and-Sand Intrusion Preventing Structure 40)

Figure 6:
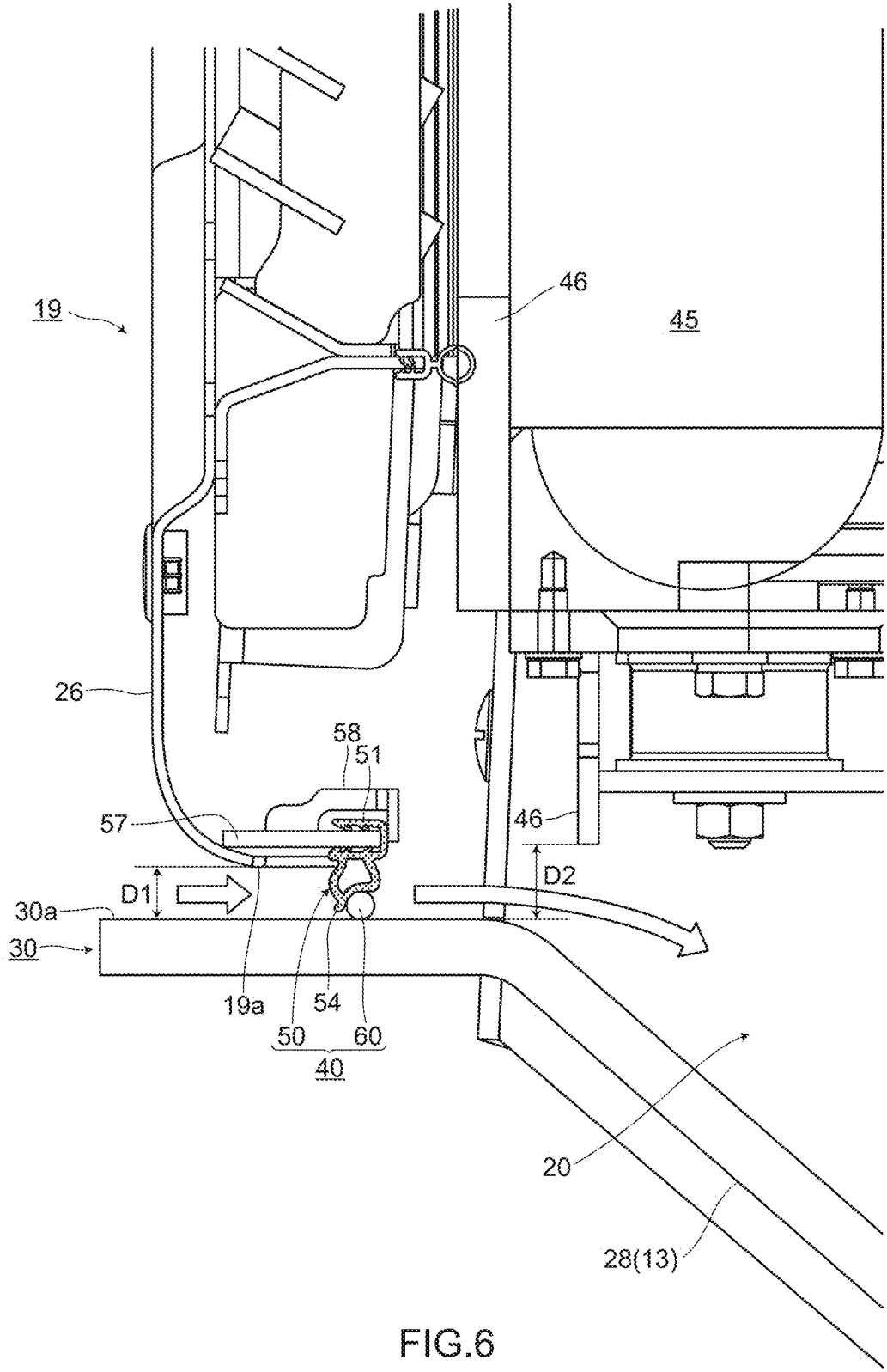
FIG. 6 is an explanatory view schematically showing the state where the rear door 19 is closed.

FIG. 6 is an explanatory view schematically illustrating a state where the rear door 19 is closed. The gap D1 is formed between the lowermost portion 19*a* of the rear door 19 and the upper surface 30*a* of the bumper 30. In a case where the soil-and-sand intrusion preventing structure 40 is not provided, as indicated by a bold arrow, soil and sand intrude into the inside of the engine compartment 20 from the gap D1, and is stacked in the inside of the engine compartment 20. However, the soil-and-sand intrusion preventing structure 40 that is constituted of the trim 50 and the soil-and-sand intrusion preventing wall member 60 closes the gap D1. Accordingly, soil and sand that intend to intrude from the outside are blocked by the soil-and-sand intrusion preventing structure 40 and hence, it is possible to prevent the intrusion of soil and sand into the inside of the engine compartment 20.

The rear door 19 has the structure where the rear door 19 is opened or closed by being rotated using the hinge mechanisms 31A, 31B (see FIG. 2) as fulcrums. Accordingly, in a case where the soil-and-sand intrusion preventing structure 40 is provided, it is required that opening and closing of the rear door 19 can be smoothly performed and the trim 50 is not damaged when the gap D1 is closed and when the rear door 19 is opened. In view of the above, a state where the trim 50 and the soil-and-sand intrusion preventing wall member 60 are brought into contact with each other and a state where the trim 50 and the soil-and-sand intrusion preventing wall member 60 are separated from each other are described.

Figure 7A:
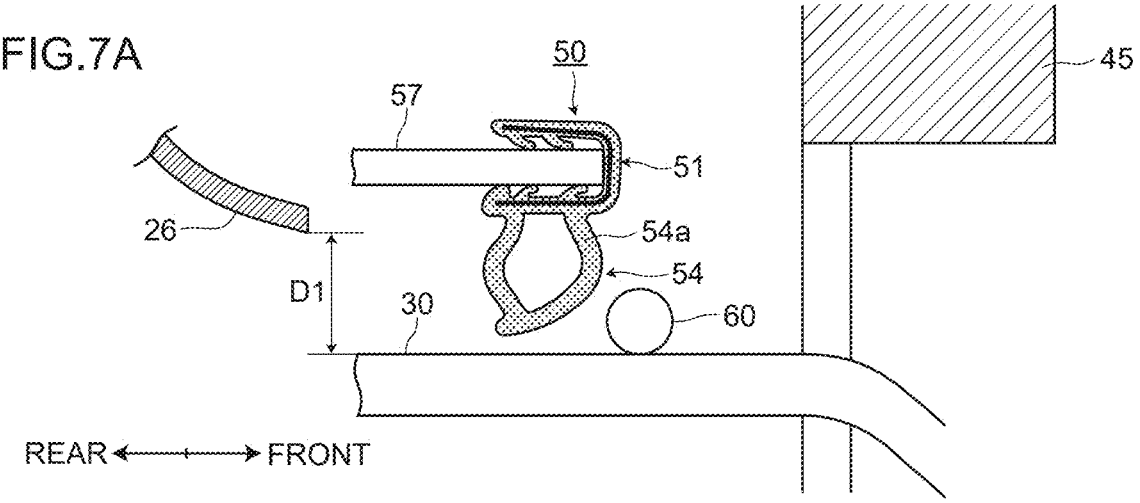
FIGS. 7A, 7B, and 7C are explanatory views, each of which is schematically illustrating an intersecting relationship between the trim 50 and the soil-and-sand intrusion preventing wall member 60.
Figure 7B:
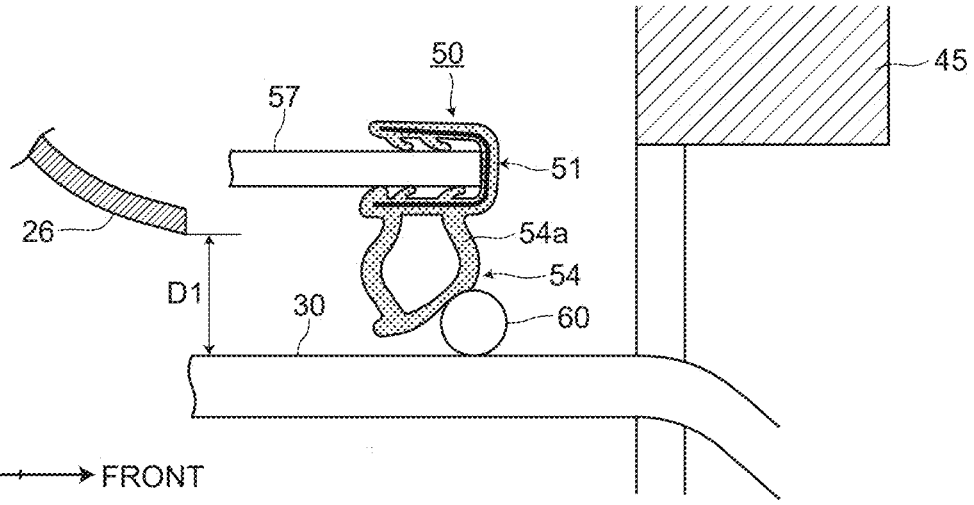
Figure 7C:
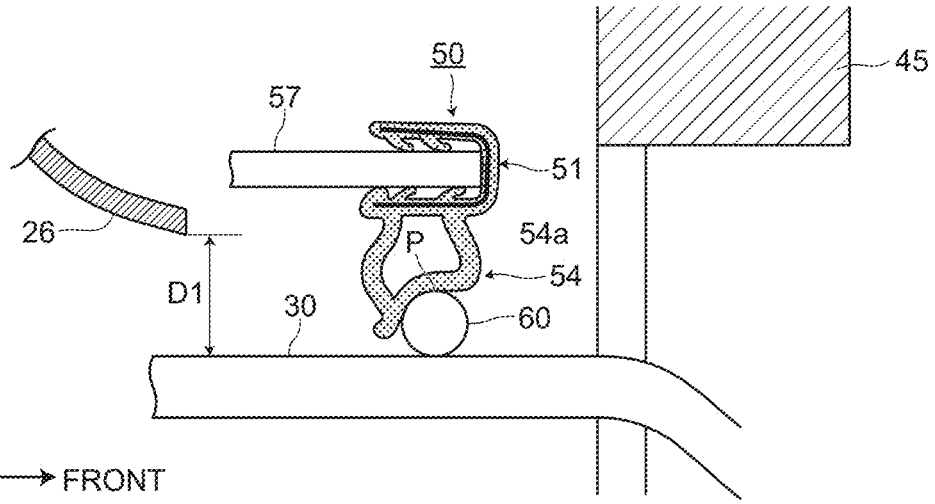

FIGS. 7A, 7B and 7C are explanatory views, each of which is schematically illustrating an intersecting relationship between the trim 50 and the soil-and-sand intrusion preventing wall member 60. FIG. 7A illustrates a state where the rear door 19 is opened. The trim 50 is not brought into contact with the soil-and-sand intrusion preventing wall member 60. In such a state, the working vehicle 1 does not perform working. FIG. 7B illustrates a state where the trim 50 is brought into contact with (intersects with) the soil-and-sand intrusion preventing wall member 60. When the sealing portion 54 of the trim 50 is brought into contact with and intersects with the soil-and-sand intrusion preventing wall member 60, the sealing portion 54 is deformed by an amount that the ring portion 54*a* intersects with the soil-and-sand intrusion preventing wall member 60. The trim 50 presses the soil-and-sand intrusion preventing wall member 60 corresponding to a deformation amount of the ring portion 54*a*. However, a pressing force of the sealing portion 54 at this stage of the operation is small and hence, such pressing does not affect opening or closing of the rear door 19.

FIG. 7C illustrates a state where the rear door 19 is fully closed. The sealing portion 54 of the trim 50 intersects with the soil-and-sand intrusion preventing wall member 60 deeper than a state illustrated in FIG. 7B. A deformation amount of the ring portion 54*a* becomes large compared to the state illustrated in FIG. 7B. Accordingly, a pressing force that the ring portion 54*a* applies to the soil-and-sand intrusion preventing wall member 60 is also increased. However, this pressing force is caused by the deformation of the ring portion 54*a* and hence, the pressing force does not largely affect opening or closing of the rear door 19. Further, a range that the sealing portion 54 (the ring portion 54*a*) is brought into contact with the soil-and-sand intrusion preventing wall member 60 is an upper surface behind a peak portion P of the soil-and-sand intrusion preventing wall member 60. Accordingly, in opening the rear door 19, there is no possibility that the sealing portion 54 is caught by a front surface side (a vehicle body 10 side) of the soil-and-sand intrusion preventing wall member 60 thus causing a damage on the trim 50.

As has been described heretofore, the soil-and-sand intrusion preventing structure 40 includes: the trim 50 having flexibility that is disposed below the rear door 19; and the soil-and-sand intrusion preventing wall member 60 that is fixed to the upper surface 30*a* of the bumper 30. The soil-and-sand intrusion preventing wall member 60 extends so as to cover the opening portion 27 between the left and right rear end wall portions 13*a*, 13*b* of the vehicle body 10 as viewed in a plan view. The trim 50 has a shape that follows a planner shape of the soil-and-sand intrusion preventing wall member 60. Further, when the rear door 19 is closed, the trim 50 is brought into contact with the soil-and-sand intrusion preventing wall member 60 over the entire length thereof. By adopting such a structure, the soil-and-sand intrusion preventing structure 40 can prevent the intrusion of the soil, sand and the like through the gap D1 formed between the lowermost portion 19*a* of the rear door 19 and the upper surface 30*a* of the bumper 30.

The soil-and-sand intrusion preventing wall member 60 is constituted of: the center extending portion 60*a*; and the distal-end-side extending portions 60*b*, 60*c* that extend from both ends of the soil-and-sand intrusion preventing wall member 60 to positions at which the distal-end-side extending portions 60*b*, 60*c* reach the rear end wall portions 13*a*, 13*b*. An angle θ that the center extending portion 60*a* makes with the distal-end-side extending portions 60*b*, 60*c* is an obtuse angle, and the center extending portion 60*a* and the distal-end-side extending portions 60*b*, 60*c* are connected to each other by circular arcs r.

By forming the soil-and-sand intrusion preventing wall member 60 in such a shape, the soil-and-sand intrusion preventing wall member 60 can maintain smooth front and back surfaces having no unevenness such as wrinkles and cracks that are liable to occur at the time of performing bending forming. When the rear door 19 is closed, it is possible to bring the trim 50 into uniform contact with the soil-and-sand intrusion preventing wall member 60 over the entire length thereof. Further, it is possible to prevent the occurrence of a case where the trim 50 is damaged due to the repeated opening and closing operations of the rear door 19. Still further, when an operator performs a maintenance, there is a case where the operator places his hands, his legs or his soles on the soil-and-sand intrusion preventing wall member 60. However, the soil-and-sand intrusion preventing wall member 60 has a circular cross section and hence, there is no concern that his hand or foot is caught by the soil-and-sand intrusion preventing wall member 60 or his hand, leg or sole is damaged by the soil-and-sand intrusion preventing wall member 60.

The trim 50 is constituted of: the trim mounting plate inserting portion 51 having a U shape where a side of the trim mounting plate inserting portion 51 into which the trim mounting plate 57 is inserted is opened; and the hollow sealing portion 54 that is disposed at a position where the sealing portion 54 is capable of being brought into contact with the soil-and-sand intrusion preventing wall member 60. The trim mounting plate inserting portion 51 has protruding portions 52*a*, 52*b*, 53*a*, 53*b* directed toward the inside. The protruding portions 52*a*, 52*b*, 53*a*, 53*b* are provided for making the mounting of the trim mounting plate 57 easy and making the removal of the trim mounting plate 57 difficult. The sealing portion 54 is formed of the hollow ring portion 54*a* having flexibility and hence, the sealing portion 54 can increase its durability while applying no excessive load to opening and closing of the rear door 19.

In the trim 50, the sealing portion 54 is disposed at a position and has a shape such that the sealing portion 54 can be brought into contact with the soil-and-sand intrusion preventing wall member 60 from a peak portion P of the soil-and-sand intrusion preventing wall member 60 to a surface of the soil-and-sand intrusion preventing wall member 60 on a rear side (the rear door 19), when the rear door 19 is closed. That is, at the position where the sealing portion 54 gets over the peak P of the soil-and-sand intrusion preventing wall member 60, a pressing force is not applied to the sealing portion 54. Accordingly, in opening the rear door 19, a large load that removes the trim 50 from the trim mounting plate 57 is not applied to the sealing portion 54 and hence, it is possible to prevent the trim 50 from being damaged.

The soil-and-sand intrusion preventing structure 40 has the trim preventing member 58. The trim 50 has the structure where the trim 50 is mounted by inserting the trim mounting plate inserting portion 51 into the trim mounting plate 57. Accordingly, by providing the trim removal preventing member 58 to the trim 50, the position of the device can be maintained stably. Particularly, it is possible to prevent the occurrence of a case where the trim 50 is removed from the trim mounting plate 57 or is deformed due to an opening operation of the rear door 19.

The invention claimed is:

1. A soil-and-sand intrusion preventing structure comprising:

a rear door that is openable and closable;

a bumper that is disposed to protrude rearward from below the rear door in a state where the rear door is closed;

a soil-and-sand intrusion preventing wall member that extends longer than an opening range of an opening portion formed between rear end wall portions of body frames that are disposed on both left and right sides of a vehicle body, and is fixed to an upper surface of the bumper; and a flexible trim mounted on a trim mounting plate disposed inside and below a peripheral edge portion of a rear door frame that constitutes the rear door, the flexible trim having a planar shape that follows a planar shape of the soil-and-sand intrusion preventing wall member, wherein the trim is configured to be brought into contact with the soil-and-sand intrusion preventing wall member over an entire length of the soil-and-sand intrusion preventing wall member in a state where the rear door is closed.

2. The soil-and-sand intrusion preventing structure according to claim 1, wherein the soil-and-sand intrusion preventing wall member is formed of a round steel bar, the soil-and-sand intrusion preventing wall includes: a center extending portion that is spaced apart from the rear end wall portion rearwardly as viewed in a plan view and extends along the rear end wall portion; and distal-end-side extending portions that extend from both ends of the center extending portion to the rear end wall portions, and an angle made by the center extending portion and the distal-end-side extending portions is an obtuse angle, and the center extending portion and the distal-end-side extending portions are connected with each other by circular arcs.

3. The soil-and-sand intrusion preventing structure according to claim 1, wherein the trim is constituted of: a trim mounting plate inserting portion having a U shape where a side of the trim mounting plate inserting portion into which the trim mounting plate is inserted is opened; and a hollow sealing portion that is disposed at a position where the sealing portion is capable of being brought into contact with the soil-and-sand intrusion preventing wall member.

4. The soil-and-sand intrusion preventing structure according to claim 3, wherein the sealing portion is positioned and has a shape so as to be brought into contact with the soil-and-sand intrusion preventing wall member from a peak portion of the soil-and-sand intrusion preventing wall member to a surface of the soil-and-sand intrusion preventing wall member on a rear side in a state where the rear door is closed.

* * * * *